US010080703B2

(12) United States Patent
Carrel et al.

(10) Patent No.: US 10,080,703 B2
(45) Date of Patent: Sep. 25, 2018

(54) ASSEMBLY COMPRISING AN ADAPTOR FOR COUPLING WITH A MEDICAL CONTAINER AND A BLISTER

(71) Applicant: Becton Dickinson France, Le Pont de Claix (FR)

(72) Inventors: Franck Carrel, Saint Jean de Vaulx (FR); Frédéric Perot, Saint Paul de Varces (FR)

(73) Assignee: Becton Dickinson France, Le Pont de Claix (FR)

( * ) Notice: Subject to any disclaimer, the term of this patent is extended or adjusted under 35 U.S.C. 154(b) by 386 days.

(21) Appl. No.: 15/023,551

(22) PCT Filed: Sep. 22, 2014

(86) PCT No.: PCT/EP2014/070149
§ 371 (c)(1),
(2) Date: Mar. 21, 2016

(87) PCT Pub. No.: WO2015/040220
PCT Pub. Date: Mar. 26, 2015

(65) Prior Publication Data

US 2016/0206510 A1 Jul. 21, 2016

(30) Foreign Application Priority Data

Sep. 23, 2013 (EP) ..... 13306294

(51) Int. Cl.
*A61J 1/20* (2006.01)
*A61J 1/14* (2006.01)
*A61J 1/18* (2006.01)

(52) U.S. Cl.
CPC ..... *A61J 1/2055* (2015.05); *A61J 1/1406* (2013.01); *A61J 1/2096* (2013.01); *A61J 1/1437* (2013.01); *A61J 1/18* (2013.01); *A61J 1/2075* (2015.05)

(58) Field of Classification Search
CPC ..... A61J 1/1406; A61J 1/1412; A61J 1/20–1/2096; B65D 51/002
See application file for complete search history.

(56) References Cited

U.S. PATENT DOCUMENTS

2012/0192976 A1 8/2012 Rahimy et al.
2015/0013811 A1* 1/2015 Carrel ..... A61J 7/0472 137/798

FOREIGN PATENT DOCUMENTS

WO 2013115728 A1 8/2013
WO 2013115729 A1 8/2013

* cited by examiner

*Primary Examiner* — Benjamin Klein
(74) *Attorney, Agent, or Firm* — The Webb Law Firm

(57) ABSTRACT

An assembly having an adaptor for coupling with a medical container having a septum. The adaptor includes a gripping member for securing the adaptor to the medical container; a pierceable elastomeric piece which, in an inactive state of the adaptor, does not contact the septum outer surface with pressure, and, in an active state of the adaptor, contacts the septum outer surface with pressure; a blister comprising a shell and a removable closing membrane forming a housing receiving the adaptor; a retaining system having a first retaining portion on the adaptor and a second retaining portion on the shell, the first retaining portion adapted, in a locked position of the retaining system, to cooperate with the second retaining portion, when the adaptor is not in the active state; and an unlocking portion adapted to transition the retaining system to an unlocked position, when the adaptor is in the active state.

15 Claims, 7 Drawing Sheets

ASSEMBLY COMPRISING AN ADAPTOR FOR COUPLING WITH A MEDICAL CONTAINER AND A BLISTER

CROSS-REFERENCE TO RELATED APPLICATIONS

This application is the United States national phase of International Application No. PCT/EP2014/070149 filed Sep. 22, 2014, and claims priority to European Patent Application No. 13306294.3 filed Sep. 23, 2013, the disclosures of which are hereby incorporated in their entirety by reference.

BACKGROUND OF THE INVENTION

Field of the Invention

The present invention relates to an assembly comprising an adaptor for a medical container and a blister housing said adaptor prior to the first use of said adaptor.

Description of Related Art

A medical container could be a bottle, an ampoule, a vial or any other container suitable for medical use. For simplicity's sake, the present invention will be described with a standard vial as a medical container.

More specifically, the invention is applicable to a vial containing a pharmaceutical product, such as a vaccine, the adaptor allowing for multiple aseptic needle piercings with an injection device to be filled with part of the product contained in the medical container.

In this application, the distal end of a component or apparatus must be understood as meaning the end furthest from the hand of the user and the proximal end must be understood as meaning the end closest to the hand of the user, with reference to the injection device intended to be used with said component or apparatus. As such, in this application, the distal direction must be understood as the direction of injection with reference to the injection device, and the proximal direction is the opposite direction, i.e. the direction of the transfer of the product from the medical container to the injection device.

One of the ways to improve health is to immunize entire populations against a number of diseases. To date, injection administration is the most common method of administering vaccines.

From a supply chain perspective, the most efficient vaccine packaging is a multidose container such as a multidose vial, that is to say, a vial that may contain up to 10, 100 or 1000 doses of vaccine, one dose being intended for one patient. These vials are usually closed by a septum. In preparation of an injection of a vaccine, the user pierces the septum of the vial with the needle of an empty syringe, he then fills the syringe with one dose of vaccine and proceeds to the injection of the vaccine to the patient.

As such, multidose vials imply that the septum of the vial be pierced successively a high number of times, namely as many as the number of doses present in the vial. In order to ensure safe injections, the sterility of both the septum and the inside of the vial should be maintained during the whole time the vial is used.

Anyway, in locations where it is difficult to maintain favorable hygienic conditions such as remote locations which are far from towns and from hospital facilities, the multidose vials may be handled and manipulated at ambient air and without strict hygiene conditions. In such cases, the pharmaceutical product stored in the vial may be contaminated either by the ambient air sucked each time a dose is removed from the vial or by contaminants coming from the outer surface of the septum or the vial and introduced by the successive piercings with the needle of the empty syringe used.

In addition, in regions where there is limited or potentially no supply of energy to power cooling equipment such as a refrigerator, the multidose vials may be maintained in cold conditions by simple contact with ice packs. As time goes by, part of the ice may melt and turn into water, and the septum of the multidose vials may be in contact with such water that could turn in a favorable medium for bacteria and fungus.

To avoid injecting contaminated pharmaceutical product or vaccine to patients, current medical regulations recommend disposing a vial used in a remote medical program after a certain time period, for example 28 days, even if pharmaceutical product remains in the vial. Consequently, it may happen that a multidose vial, such as for example a 10-dose vial, is opened and that only three doses are used, for vaccinating three patients only, the remaining content of the vial being wasted because not intended to be administered in a sufficiently short time after opening of the vial in order to guaranty the vaccine or drug sterility.

Vaccination campaigns can therefore be made difficult in some regions and a significant proportion of vaccines may be wasted by the time they reach their target. This has an unacceptable cost to the health organizations in charge of immunization campaigns. In addition, it may happen that in case of vaccination campaigns, or pandemic, hundreds of patients need to be vaccinated in a very short time, in locations where it is difficult to maintain favorable hygienic conditions such as remote locations which are far from towns and from hospital facilities.

Therefore, it has been proposed to provide a device that allows several successive piercings of a multidose vial septum and that ensures that said piercings be carried out in aseptic conditions. In particular, the septum must be preserved from contaminants during the lifetime of the multidose vial, and no contaminated air should be sucked inside the vial in order to avoid wastage of the drug, even if the multidose vial is not stored or manipulated in aseptic conditions.

A known device of this type is an adaptor for coupling with the medical container, the adaptor comprising a gripping member for securing the adaptor to the medical container, and a pierceable elastomeric piece.

When the adaptor is in an inactive state, the pierceable elastomeric piece is spaced apart from the outer surface of the septum, thereby allowing an easy mounting of the medical container on the adaptor;

When the adaptor is in an active state, the pierceable elastomeric piece is in contact with pressure with the outer surface of the septum, thereby ensuring an efficient protection of the septum against contamination by foreign elements and preventing potentially contaminated outside air to reach the inside of the vial and thus the pharmaceutical product.

For example, the adaptor can comprise a gripping member and a compressive member including the pierceable elastomeric piece, the compressive member being movable relative to the gripping member from the inactive state towards the active state.

Prior to its first use, such an adaptor is received in a blister comprising a shell and a removable closing membrane, and is stored in the inactive state.

After having opened the blister, when a user decides to fill in an empty syringe with a dose of drug contained in the medical container, he simply places the adaptor on the medical container by means of the gripping member. Once the adaptor is placed on the medical container, the compressive member has to be moved towards the active state, in which the pierceable elastomeric piece is in contact, for example in tight contact, with the outer surface of the septum of the medical container. As a consequence, introducing the needle in the medical container implies that the needle pierces and traverses the elastomeric piece of the adaptor in the first place. During this step, the needle mechanically rubs against the material forming the elastomeric piece and it is naturally cleaned, as the potential bacteria or contaminants are wiped out from the needle when said needle penetrates the elastomeric piece. In addition, once the needle protrudes out of the elastomeric piece of the adaptor, it directly enters the septum of the medical container and may therefore not be contaminated by foreign elements. Indeed, since the pierceable elastomeric piece is in contact with the outer face of the septum when the adaptor is secured on the medical container, no ambient air is sucked into the vial due to the vacuum created when a dose is removed.

The user may remove the next dose with a new empty injection device until all the doses contained in the medical container are removed.

For such an adaptor to act as an effective protection of the septum, it is necessary to ensure that the pierceable elastomeric piece is in tight contact with the outer surface of the septum.

Nevertheless, in practice, when the user opens the closing membrane of the blister to place the adaptor on the medical container, it may happen that the adaptor slide out from the blister and touch contaminated surfaces such as the ground, unclean hands or furniture, and be placed on the medical container despite its contamination.

Furthermore, it appears that users do not always properly perform the mounting process of the adaptor. Thus, sometimes, a user may not place the adaptor in the active position, for example may not completely move the compressive member towards the active position, resulting in the pierceable elastomeric piece not being in contact with pressure with the septum, and therefore not providing the protection fully meeting the hygienic requirements.

Finally, it may happen that the healthcare workers handle the adaptor and the medical container with unclean hands, for example in remote area where water supply is scarce, thus leading to surface contamination of the adaptor, the pierceable elastomeric piece or the medical container during the step of securing the adaptor on the medical container.

Therefore, it would be desirable to provide a system that would prevent the misuse of such adaptors, to limit contacts between the users' hands and the system, and to guaranty the medical container is always handled with the greatest hygienic conditions possible.

SUMMARY OF THE INVENTION

The invention relates to an assembly comprising:

an adaptor for coupling with a medical container having a neck closed by a septum, said septum having an outer surface directed towards the outside of the medical container, the adaptor comprising:

a gripping member for securing the adaptor to the medical container, said gripping member being capable of being mounted on the neck of said medical container;

a pierceable elastomeric piece which, in an inactive state of the adaptor, is intended not to be in contact with pressure with the outer surface of the septum and which, in an active state of the adaptor, is intended to be in contact with pressure with the outer surface of the septum—when said adaptor is placed on said medical container;

a blister comprising a shell and a removable closing membrane which form a housing receiving the adaptor with the adaptor in the inactive state, prior to the first use of the adaptor.

According to the invention, the assembly further comprises:

a retaining system which comprises first retaining means arranged on the adaptor and second retaining means arranged on the shell, the first retaining means being designed, in a locked position of the retaining system, to cooperate with the second retaining means, as long as the adaptor is not in the active state, so as to prevent the shell from being separated from the adaptor;

unlocking means which are designed to place the retaining system in an unlocked position, when the adaptor is in the active state, in which unlocked position the first retaining means do not cooperate with the second retaining means, thereby allowing removal of the shell.

Thus, prior to the first use, the adaptor is housed and protected in the blister, the adaptor being in the inactive state. When a user wants to use the adaptor, he first removes the closing membrane.

For filling an empty syringe with a dose of drug contained in the medical container, the adaptor has to be removed from the shell of the blister. However, owing to the invention, and more particularly to the retaining system, this is not possible until the adaptor is in the active state. As a result, the invention makes it possible to ensure that the adaptor cannot slide out from the blister and is properly positioned before a syringe can be filled, while limiting contamination coming from the users' hands.

In practice, after having removed the closing membrane, the user has to place the adaptor—still located in the shell—on the medical container. In the inactive state, the pierceable elastomeric piece is not in contact with pressure with the outer surface of the septum, and placing the gripping member on the medical container only requires a limited effort. In other words, "not in contact with pressure" means either spaced apart or in loose contact.

Then, the user places the adaptor in the active state, by pressing on the shell towards the medical container, i.e. in the distal direction. As long as the adaptor is not in the active state, the shell cannot be removed because the retaining system is in the locked position—i.e. a fully locked position when the adaptor is in the inactive position and in a locked position when the adaptor is in an intermediate position between the inactive and the active positions. Only when the adaptor is in the active position can the shell be removed, the unlocking means having placed the retaining system in the unlocked position.

Once in its active state, the adaptor exerts a pressure on the pierceable elastomeric piece, even after the user has released his initial distal pressure on the adaptor—or shell. This ensure that the outer surface of the septum and the complementary surface of the pierceable elastomeric piece are in air-tight contact together and that no ambient air or contamination is trapped between the outer surface of the septum and the complementary surface of the pierceable elastomeric piece. The distal tip of the needle may not enter in contact with other elements than the pierceable elastomeric piece and the septum when it successively traverses the pierceable elastomeric piece and the septum. Furthermore, the interface between the septum and the pierceable elastomeric piece is now sealed: no ambient air can be sucked into the medical container when the needle is removed from the pierceable elastomeric piece and the medical container septum.

The user is not allowed to remove the shell and to handle directly the adaptor before the adaptor is in the active state. On the contrary, the invention ensures that the user has succeeded in placing the adaptor in the active state, while avoiding direct contacts with hands or unclean surface. It also provides a solution to guaranty that the adaptor is in the active state when an empty syringe is filled with one dose of drug contained in the medical container. Indeed, filling the syringe would not be possible with the shell still on the adaptor, and the shell can only be removed if the adaptor is in the active state.

In the present application, "pierceable" means that the septum and the elastomeric piece of the adaptor may be pierced and traversed by the needle of an injection device such as a syringe, an auto-injector, or a reconstitution device, for example for administering a pharmaceutical product such as a drug or a vaccine.

The gripping member of the adaptor of the invention may be any member capable of securing the adaptor around on the medical container, and in particular around the neck of the medical container, either in a temporary or permanent way.

The pierceable elastomeric piece of the adaptor of the invention has at least a part intended to be in contact with the outer surface of the septum when said adaptor is secured on said medical container: in other words, the elastomeric piece has a design, shape, and location on the adaptor, allowing a part of it to be in contact, in particular in close contact, with the outer surface of the septum when said adaptor is secured on said medical container.

In an embodiment of the invention, one of the first retaining means and the second retaining means comprise a notch and the other of the first retaining means and the second retaining means comprise a projecting member, the notch being opened towards the projecting member and the projecting member projecting towards the notch.

Such a projecting member can move and/or can be deformed or broken from a locked to an unlock position.

For example, the first retaining means comprise a projecting member projecting from the adaptor—for example from the gripping member—towards the shell, and the second retaining means comprise a notch opening towards the adaptor—for example towards the gripping member.

In an embodiment of the invention, the unlocking means comprise a wall which, when the adaptor changes from its inactive position to its active position, is designed to come in contact with a part of the retaining system and to cause said part to move or to break, in order to place the retaining system in the unlocked position. Unlocking of the adaptor from the shell is therefore realized in the same movement as the activation of the adaptor. No additional gesture is required from the user and the assembly is therefore straightforward to use for any medical staff without particular training.

More specifically, with an adaptor comprising a gripping member and a compressive member movable relative the gripping member from an inactive state (of the compressive member and of the adaptor) to an active state (of the compressive member and of the adaptor), the unlocking means can comprise a wall which, when the compressive member is moved towards its active position, is designed to come in contact with a part of the retaining system and to cause said part to move, to place the retaining system in the unlocked position. For example, said wall can come in contact with the first retaining means as a projecting member, and cause them to move towards the unlocked position.

The adaptor may be made of a single part including the gripping member and the pierceable elastomeric piece, said part being designed, for example, to be mounted on the medical container by a distal movement of the adaptor, snap-fitting the adaptor on the medical container neck. In such an embodiment, the unlocking means can comprise a ring capable of moving distally towards the medical container to cause the first retaining means to move towards the unlocked position or to break.

In another embodiment, in addition to the gripping member, the adaptor comprises a compressive member which comprises said pierceable elastomeric piece and which is movable relative to the gripping member from an inactive state, in which the pierceable elastomeric piece is intended not to be in contact with pressure with the outer surface of the septum—when said adaptor is placed on said medical container—towards an active state, in which the pierceable elastomeric piece is intended to be in contact with pressure with the outer surface of the septum—when said adaptor is placed on said medical container.

Then, the user can move the compressive member towards the active state by pressing on the shell towards the medical container, i.e. in the distal direction. As long as the compressive member is not in the active position, the shell cannot be removed because the retaining system is in the locked position. Only when the compressive member is in the active position can the shell be removed, the unlocking means having placed the retaining system in the unlocked position.

In an embodiment, the first retaining means are arranged on the gripping member, and the unlocking means are arranged on the compressive member.

In an embodiment, the gripping member comprises a body, the first retaining means being arranged on the gripping member and comprising at least one projecting member which projects from said body towards the shell, in the locked position, and which can be broken or deformed towards the unlocked position in which it substantially does not protrude from the body. Preferably, the body and the first retaining means can be made as a single piece.

The projecting member can comprise at least one breakable or flexible tab which projects outwardly and distally from the body, in the locked position, and which can be broken or deflected substantially against the body.

In an embodiment, the gripping member is a lateral clipping member having a U-shaped body intended to be engaged on the neck of the medical container via the opening of the U-shaped body, the curved part of the U-shaped body partially surrounding the neck, the first retaining means being arranged on the gripping member substantially on at least one of the free ends of the U-shaped body.

In an embodiment, the gripping member comprises first guiding means designed to cooperate with second guiding means arranged on the compressive member to allow guiding the movement of the compressive member relative to the gripping member from the inactive state towards the active state, according to a longitudinal translation in the distal direction.

For example, a part of the second guiding means can form the unlocking means.

The first guiding means can comprise a substantially longitudinal leg and the second guiding means can comprise a substantially longitudinal housing which receives said leg and has an open distal end, a flexible tab pertaining to the first retaining means extending from the distal end of the leg and coming out from the open distal end of the longitudinal housing.

As a result, when the compressive member moves towards the active position, the flexible tab comes in contact with the distal end of the longitudinal housing which thus forms the wall which pertains to the unlocking means and causes the retaining system to be placed in the unlocked position, as previously described. In practice, said distal end of the longitudinal housing can cause the deflection of the flexible tab.

In practice, the compressive member can be arranged around the gripping member and coaxially with the gripping member. Therefore, the longitudinal housing can be open radially inwardly to receive a leg protruding radially outwardly from the gripping member. The active position can be a position in which the gripping member is located substantially inside the compressive member, and where the gripping member does not substantially extend neither distally nor proximally from it. In this position, the adaptor could be locked in a permanent way on the neck of a medical container.

In an embodiment, the compressive member comprises first rotational blocking means designed to cooperate with second rotational blocking means arranged on the inner lateral face of the shell, to prevent a rotation of the compressive member relative to the shell around a longitudinal axis. These rotational blocking means are valuable for a straightforward assembly of the adaptor onto a medical container.

The first rotational blocking means can be located on the compressive member adjacent the longitudinal housing and the second retaining means can be located on the shell adjacent the second rotational blocking means.

The first rotational blocking means can comprise a substantially longitudinal slot and the second rotational blocking means can comprise a substantially longitudinal rib having a notch pertaining to the second retaining means.

Furthermore, the gripping member and the compressive member can comprise means capable to cooperate to maintain the compressive member in the inactive or in the active position relative to the gripping member. Said means are arranged to allow the compressive member to move towards the active position. Preferably, said means can further be arranged to prevent the compressive member, when in the active position, to move back towards the inactive position. Said means are preferably distinct from the first retaining means and from the unlocking means. For example said means can comprise one or several pegs intended to engage one or several recesses.

The assembly can further comprise a medical container having a neck closed by a septum, said septum having an outer surface directed towards the outside of the medical container.

The invention also relates to an assembly comprising:

an adaptor for coupling with a medical container having a neck closed by a septum, the septum having an outer surface directed towards an outside of the medical container, the adaptor comprising:

a gripping member for securing the adaptor to the medical container, the gripping member adapted to be mounted on the neck of the medical container;

a pierceable elastomeric piece which, in an inactive state of the adaptor, is not in contact with pressure with the outer surface of the septum, and which, in an active state of the adaptor, is in contact with pressure with the outer surface of the septum when the adaptor is placed on the medical container;

a blister comprising a shell and a removable closing membrane which form a housing for receiving the adaptor with the adaptor in the inactive state, prior to the first use of the adaptor;

wherein the assembly further comprises:

a retaining system which comprises a first retaining portion arranged on the adaptor and a second retaining portion arranged on the shell, the first retaining portion being adapted, in a locked position of the retaining system, to cooperate with the second retaining portion, as long as the adaptor is not in the active state, so as to prevent the shell from being separated from the adaptor;

an unlocking member adapted to transition the retaining system to an unlocked position, when the adaptor is in the active state, in which unlocked position the first retaining portion does not cooperate with the second retaining portion, thereby allowing removal of the shell.

One of the first retaining portion and the second retaining portion may comprise a notch and the other of the first retaining portion and the second retaining portion may comprise a projecting member, the notch being opened towards the projecting member and the projecting member projecting towards the notch.

The unlocking member may comprise a wall which, when the adaptor changes from its inactive position to its active position, comes in contact with a part of the retaining system and causes the part to move or to break in order to place the retaining system in the unlocked position.

The adaptor may further comprise a compressive member, comprising the pierceable elastomeric piece, that is movable relative to the gripping member from an inactive state in which the pierceable elastomeric piece is not in contact with pressure with the outer surface of the septum when the adaptor is placed on the medical container towards an active state in which the pierceable elastomeric piece is in contact with pressure with the outer surface of the septum when the adaptor is placed on the medical container.

The first retaining portion may be arranged on the gripping member, and the unlocking member may be arranged on the compressive member.

The gripping member may comprise a body, and the first retaining portion may be arranged on the gripping member and comprise at least one projecting member which projects from the body towards the shell in the locked position and which can be broken or deformed towards the unlocked position such that the at least one projecting member does not substantially protrude from the body. The projecting member may comprise at least one breakable or flexible tab which projects outwardly and distally from the body in the locked position, and which can be broken or deflected substantially against the body.

The gripping member may be a lateral clipping member having a U-shaped body adapted to be engaged on the neck of the medical container via an opening of the U-shaped body, a curved part of the U-shaped body partially surrounding the neck, and the first retaining portion may be arranged on the gripping member substantially on at least one free end of the U-shaped body.

The gripping member may comprise a first guiding portion designed to cooperate with a second guiding portion arranged on the compressive member to guide the movement of the compressive member relative to the gripping member from the inactive state towards the active state, according to a longitudinal translation in a distal direction. A part of the second guiding portion may form the unlocking member. The first guiding portion may comprise a substantially longitudinal leg and the second guiding portion may comprise a substantially longitudinal housing which receives the leg and has an open distal end, wherein a flexible tab-extends from a distal end of the leg and comes out from the open distal end of the longitudinal housing.

The compressive member may comprise a first rotational blocking portion adapted to cooperate with a second rotational blocking portion arranged on an inner lateral face of the shell to prevent rotation of the compressive member relative to the shell around a longitudinal axis. The first rotational blocking portion may be located on the compressive member adjacent the longitudinal housing and the second retaining portion may be located on the shell adjacent the second rotational blocking portion. The first rotational blocking portion may comprise a substantially longitudinal slot and the second rotational blocking portion may comprise a substantially longitudinal rib having a notch for cooperating with the second retaining portion.

The assembly may further comprise a medical container having a neck closed by a septum, the septum having an outer surface directed towards an outside of the medical container.

These and other features and advantages will become apparent upon reading the following description in view of the drawing attached hereto representing, as non-limiting examples, embodiments of an assembly according to the invention.

BRIEF DESCRIPTION OF THE DRAWINGS

The following detailed description of several embodiments of the invention is better understood when read in conjunction with the appended drawings, it being however understood that the invention is not limited to the specific embodiments disclosed.

DESCRIPTION OF THE INVENTION

Figure 1:
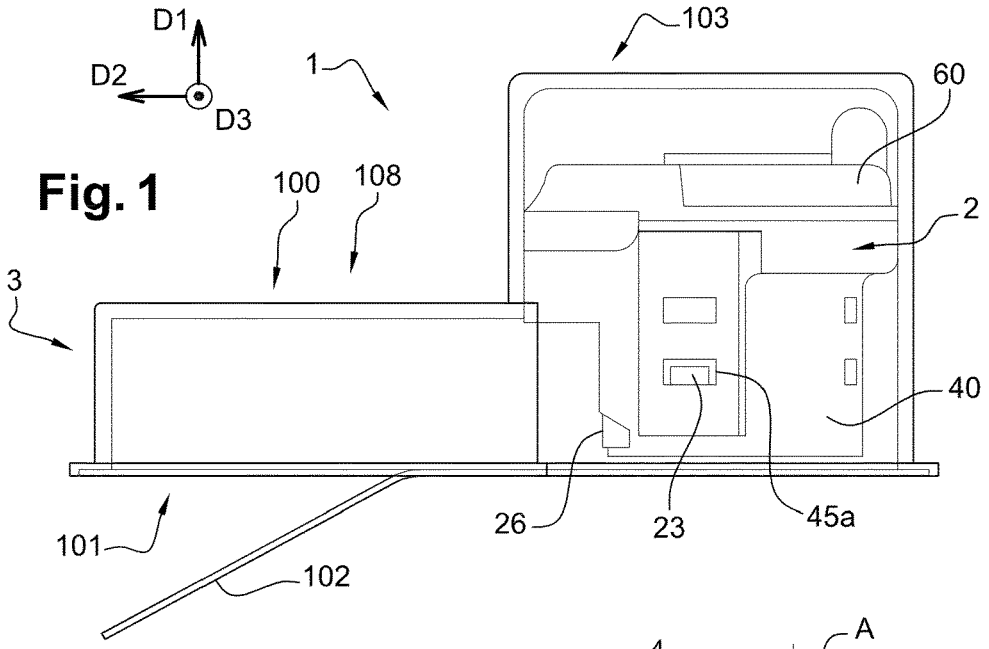
FIG. 1 is a side view of an assembly according to the invention, showing an adaptor housed in a blister, the blister comprising a shell illustrated as a transparent piece and a closing membrane partially removed.

As shown in FIG. 1, the invention relates to an assembly 1 which basically comprises an adaptor 2 and a blister 3.

Figure 2:
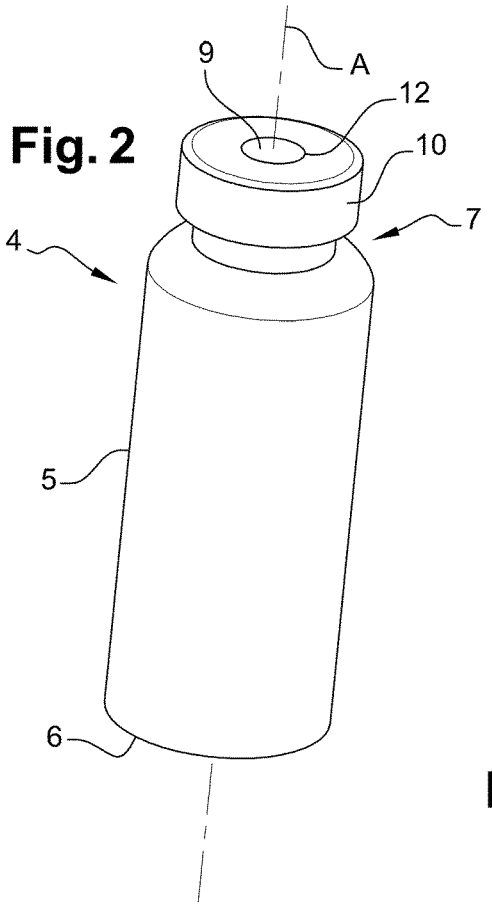
FIG. 2 is a perspective view of a medical container on which the adaptor of FIG. 1 can be secured.
Figure 3:
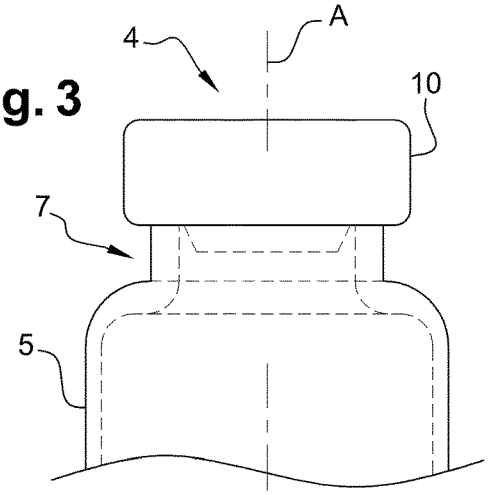
FIG. 3 is a detailed side view of said container.
Figure 4:
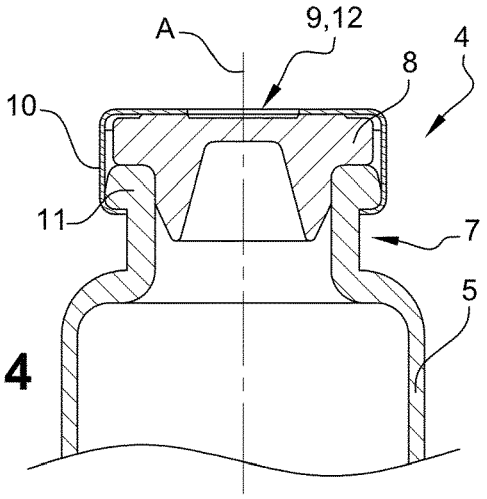
FIG. 4 is a longitudinal cross section view of said container.

The adaptor 2 is designed to be mounted on a medical container 4 as a vial which is illustrated on FIGS. 2 to 4. The medical container 4 is intended to contain a pharmaceutical product, and can typically be a vial containing a drug or a vaccine. The medical container 4 generally comprises a tubular barrel 5 having a longitudinal axis A, said tubular barrel 5 being closed at a first end 6 and having a neck 7 opened at the opposite end.

In order to close the opening of the medical container 4, a septum 8 is inserted in the neck 7. The septum 8 is usually made of a material impermeable to gas and liquids, and it hermetically seals the content of the medical container 4. The septum 8 is also pierceable by a needle of an injection device intended to be filled with the product contained into the medical container, said septum 8 being accessible to said needle via its outer surface 9. Here, the term "outer surface" mean the surface directed towards the outside of the medical container.

Usually, the septum 8 is fixedly attached to the neck 7 of the medical container 4 by means of a collar 10 which is secured on a peripheral edge 11 of said neck 7 and which has a central opening 12 leaving access to a central portion of the outer surface 9 of the septum 8.

Depicted in FIG. 1 are:

the longitudinal direction D1, which in use is coincident with the medical container axis A, and with respect to which are used the terms "axial", "proximal", "distal", "top" and "bottom";

the lateral direction D2 which is orthogonal to D1;

and the transversal direction D3 which is orthogonal to D1 and D2.

The term "transversal" refers to a plane or a direction orthogonal to the longitudinal direction D1.

The term "radial" refers to a direction according to a diameter of cylindrical parts, with the term "inner" referring to elements closer to the axis as compared with the term "outer".

Figure 5:
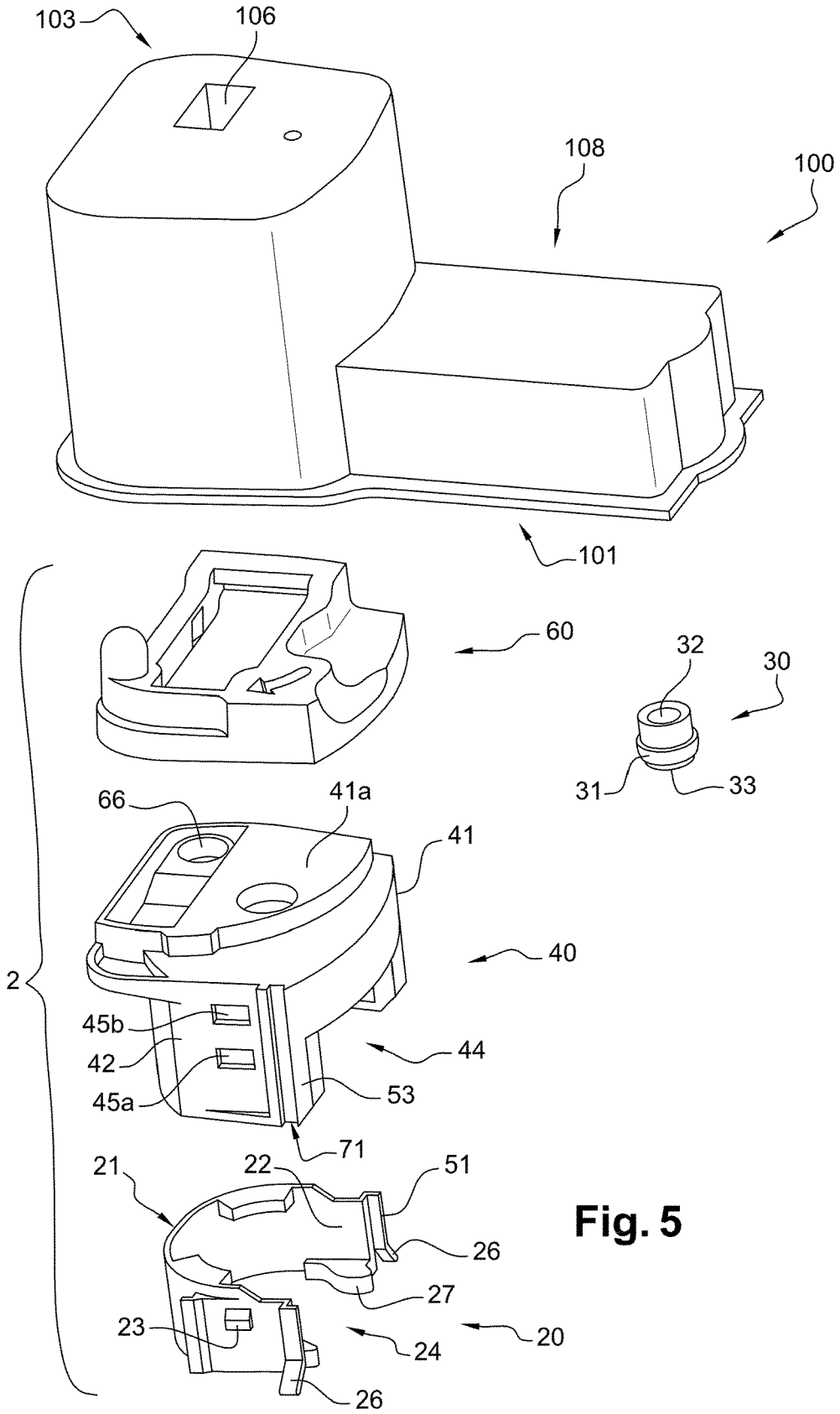
FIG. 5 is an exploded perspective view of the assembly of FIG. 1.
Figure 6:
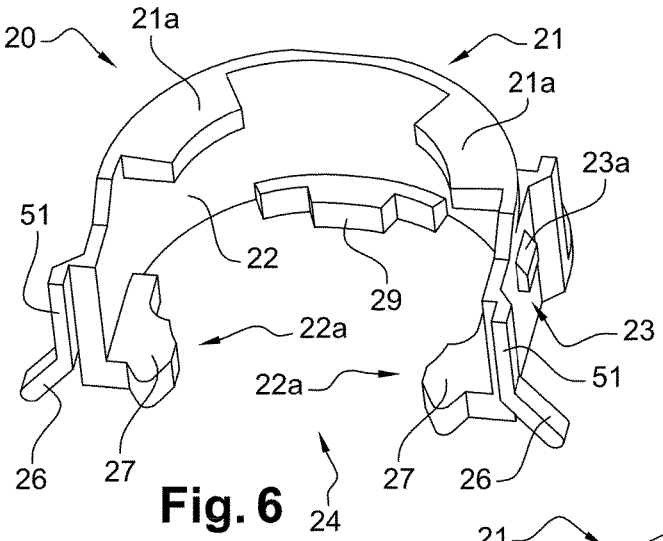
FIGS. 6 to 9 show a gripping member which pertains to the adaptor, respectively in a front perspective view, in a top view, in a rear perspective view, and in a front view.

As shown in FIGS. 1 and 5, the blister 3 comprises a shell 100 which can be made of a semi rigid plastic material and has a distal aperture 101. The blister 3 further comprises a closing membrane 102 which, prior to the first use of the adaptor 2, i.e. in a storage state, closes the aperture 101. As schematically illustrated in FIG. 1, the closing membrane 102 can be removed by a user. The shell 100 and the closing membrane 102 form a housing receiving the adaptor 2 prior to the first use of the adaptor 2.

The adaptor 2 comprises a gripping member 20 for securing the adaptor 2 to the medical container 4, said gripping member 20 being capable of being mounted on the neck of said medical container. The adaptor 2 further comprises a compressive member 40 comprising a pierceable elastomeric piece 30.

The adaptor 2 may further comprise a cover 60 intended to prevent or allow access to the septum 8 of the medical container 4, once the adaptor 2 is coupled to the medical container 4. For example, the cover 60 may be rotated about a longitudinal axis, with respect to the gripping member 20 and compressive member 40, between a first position, in which it covers the septum 8, and a second position, in which the septum 8 is accessible.

The gripping member 20 is now described in detail with reference to FIGS. 6 to 9.

In the embodiment of FIGS. 6 to 9, the gripping member 20 is a lateral clipping member and comprises a U-shaped body 21, having a partially tubular wall 22 showing a height—along D1—suitable for surrounding the collar 10 of the vial 4 (see FIG. 19), with two free ends 22*a* corresponding to the ends of the branches of the U. The gripping member 20 is intended to be engaged on the neck 7 of the medical container 4 via the opening 24 of the U-shaped body 21, the curved part of the U-shaped body 21 partially surrounding the neck 7.

The terms "front" or "forward" are used with respect to direction D2 for elements located on the side of the opening 24 or directed towards said opening 24, while the term "rear" is used for elements located on the side of the curved part of the U-shaped body 21.

Close to each free end 22*a*, the tubular wall 22 is provided on its outer surface with a peg 23 having a sloped proximal face 23*a* and a substantially transversal distal face 23*b*. In its circular portion, the partially tubular wall 22 is further provided on its outer surface with a rear peg 25 having a sloped proximal face 25*a* and a substantially transversal distal face 25*b* (see FIG. 8). The distal faces 23*a*, 25*b* of the pegs 23, 25 are located substantially in one and the same transversal plane.

Figure 9:
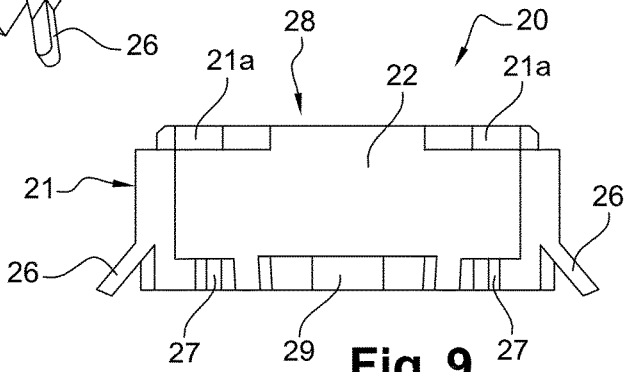

In its circular portion, the partially tubular wall 22 is further provided on its inner surface with a forward projection 29. Each free end 22*a* is further provided with a distal front projection forming a radial rim 27. As shown in FIG. 9, the proximal faces of the forward projection 29 and radial rims 27 are located substantially in one and the same transversal plane and form a support for the distal face of the peripheral edge 11 of the neck 7 of the medical container 4 (see FIG. 19 for example).

The U-shaped body 21 is further provided at its proximal end with an inner annular rim 21*a*, here discontinuous, forming a central hole 28.

The gripping member 20 also comprises a connection member 65 protruding radially outwardly from the tubular wall 22 and designed to cooperate with a part of the cover 60 to allow said cover 60 to rotate between its first and second positions. This connection member 65 will not be described in detail.

Figure 7:
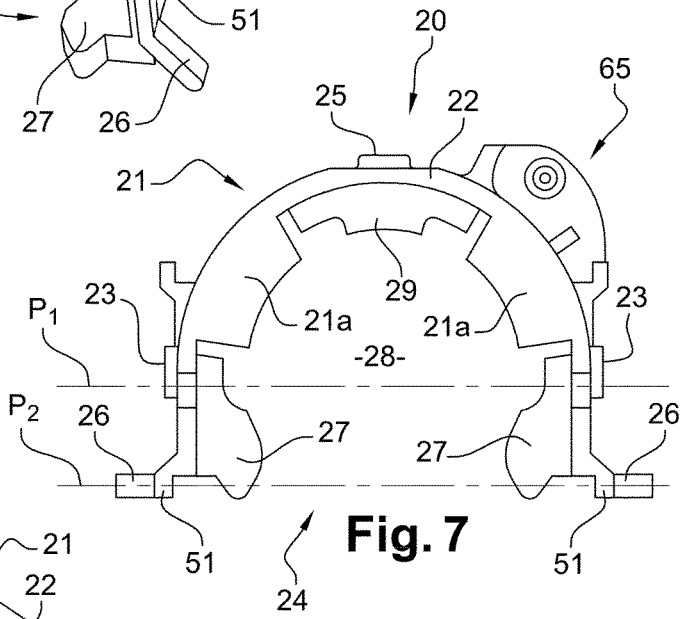
Figure 8:
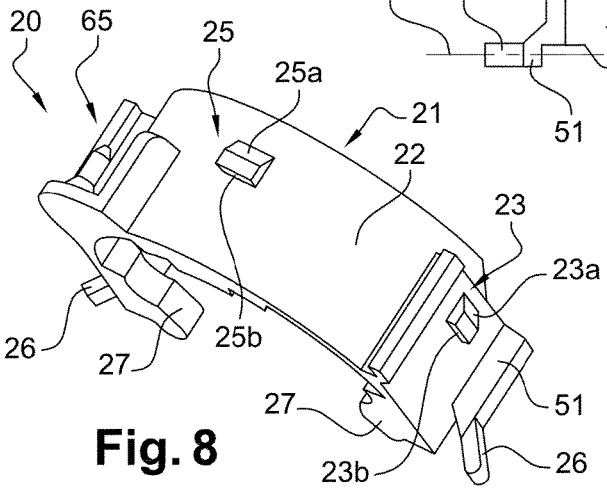

The gripping member 20 further comprises first guiding means which, in the embodiment shown, comprise a substantially longitudinal leg 51 projecting from the U-shaped body 21 close to each free end 22*a* of the tubular wall 22. Each leg 51 projects forward and outward from said tubular wall 22, as shown in FIG. 7.

From the distal end of each leg 51 extends a flexible tab 26. Each flexible tab 26 projects from the U-shaped body 21 outwardly and distally in a locked position, as shown in FIGS. 6 to 9 and 20. Moreover, the flexible tabs 26 can be deflected substantially against the body 21, for example to be substantially aligned with the corresponding leg 51 as will be explained later (see FIG. 24). In the illustrated embodiment, the distal ends of the legs 51 are located distally from the distal face of the radial rims 27.

The flexible tabs 26 pertain to or constitute first retaining means arranged on the gripping member 20.

In another embodiment (not shown), the gripping member is an axial gripping member and comprise a tubular body.

Figure 10:
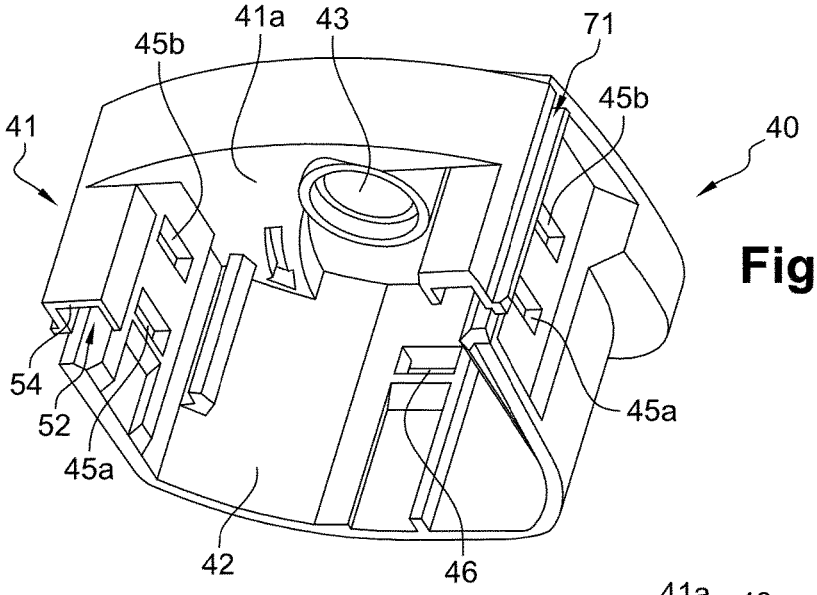
FIGS. 10 and 11 show a compressive member which pertains to the adaptor, respectively in a front perspective view and in a bottom view.
Figure 11:
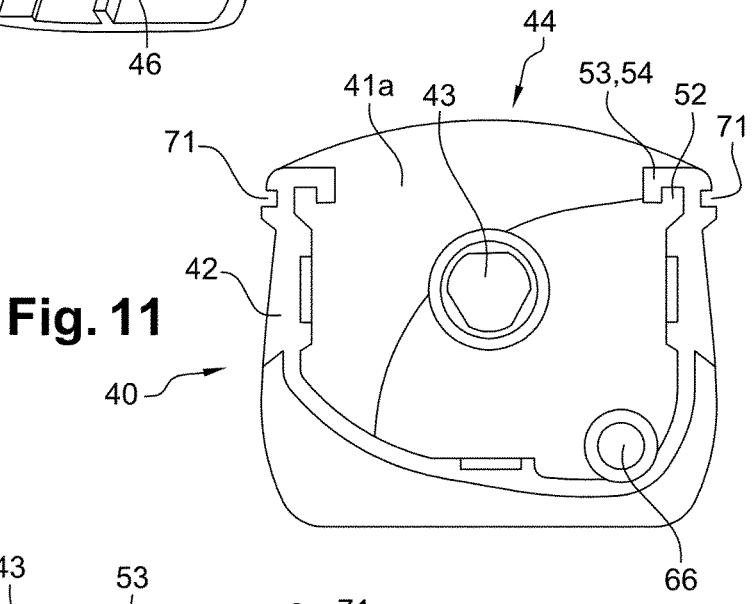

The compressive member 40 is now described in detail with reference to FIGS. 10 and 11.

Figure 12:
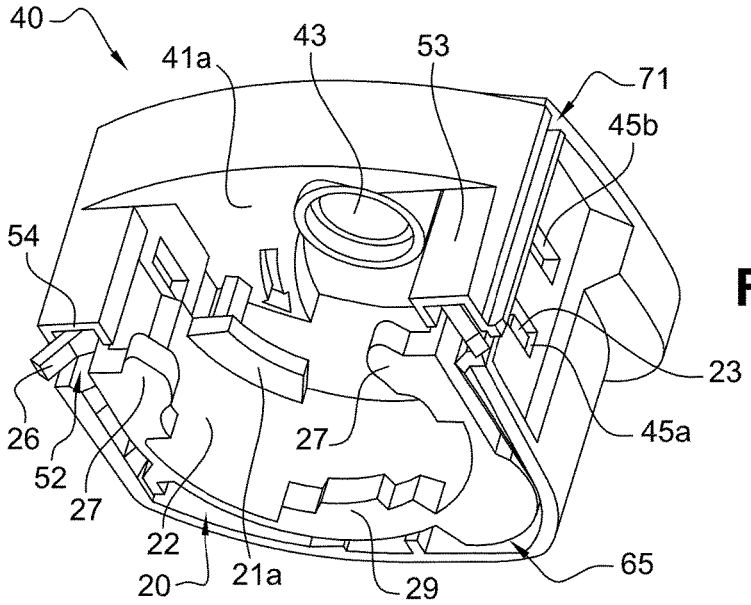
FIG. 12 is a view similar to FIG. 10, with the gripping member assembled in the compressive member, the latter being in the inactive state.
Figure 13:
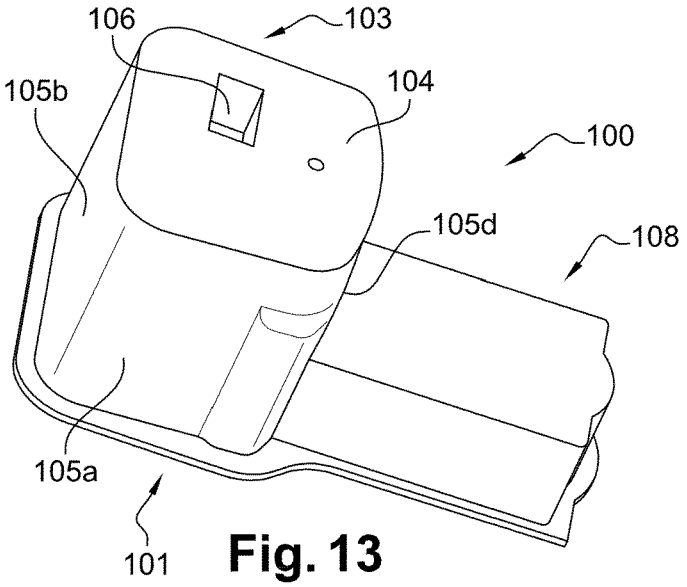
FIGS. 13 to 15 show the shell of the blister of FIG. 1, respectively in a top perspective view, in a bottom perspective view, and in cross-section in the plane P15 of FIG. 14.
Figure 15:
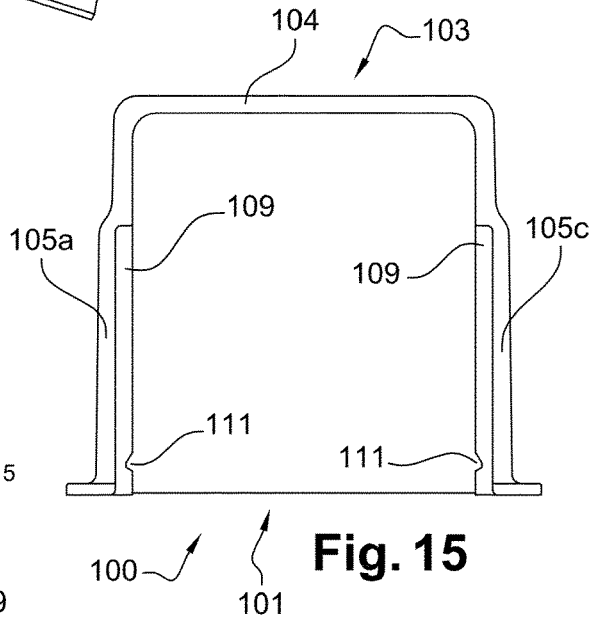
Figure 14:
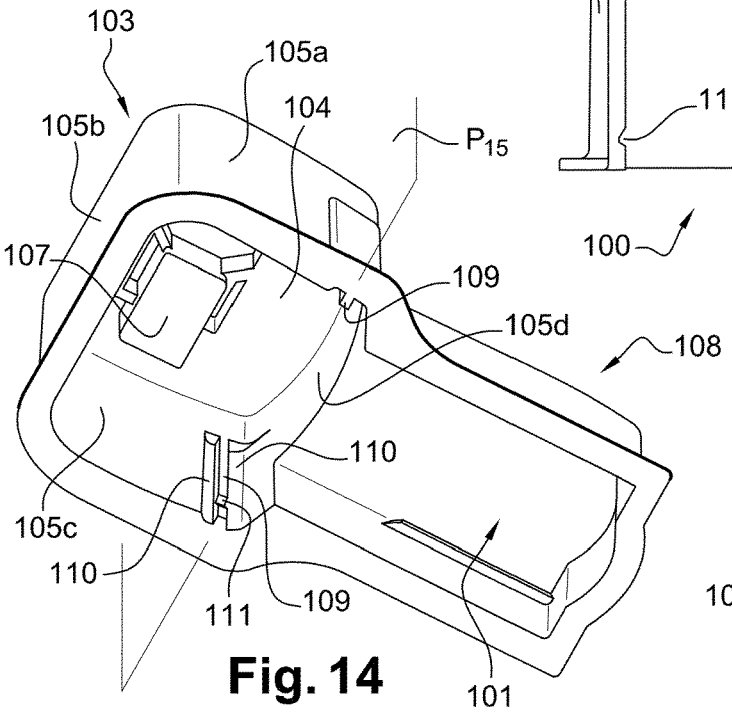

The compressive member 40 comprises a cap 41, formed of a tubular wall 42 closed at its proximal end by a transversal wall 41*a*. The cap 41 is sized and shape for receiving therein the gripping member 20, as shown in FIG. 12. The transversal wall 41*a* is provided with a central hole 43 for receiving the elastomeric piece 30 (see FIG. 17 for example).

In the embodiment shown, the pierceable elastomeric piece 30 has globally the shape of a cylinder provided with an annular outer bead 31, a proximal cavity 32, and a substantially flat distal transversal face 33. As shown on FIG. 17, for example, the pierceable elastomeric piece 30 is dimensioned and shaped so as to be received within central hole 43 of the transversal wall 41*a* of the cap 41 with friction and/or snap-fitting means. In embodiments not shown, the pierceable elastomeric piece 30 may have any suitable shape complementary to that of the central hole 43 of the transversal wall, such as a cubic shape, etc.

The pierceable elastomeric piece 30 is made of a material impermeable to gas and liquid capable of flexing under pressure. For example, the elastomeric piece has a thickness ranging from 1 to 8 mm, preferably from 2 to 4 mm. The elastomeric piece may show a hardness ranging from 10 to 100 Shore A, preferably from 40 to 70 Shore A, measured according to DIN 53505.

Suitable materials for the pierceable elastomeric piece 30 of the adaptor of the invention include natural rubber, acrylate-butadiene rubber, cis-polybutadiene, chlroro or bromobutyl rubber, chlorinated polyethylene elastomers, polyalkylene oxide polymers, ethylene vinyl acetate, fluorosilicone rubbers, hexafluoropropylene-vinylidene fluoride-tetrafluoroethylene terpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

Preferably, the elastomeric piece is self-resealing and it seals the hole produced by the piercing of the needle, automatically and rapidly, for example in less than 0.5 seconds, once the needle is removed from the elastomeric piece. This automatic closure step may occur a high number of times, in particular as many times as necessary for removing the numerous doses of product initially present in the multidose medical container 4. This automatic obstruction restricts or prevents air and/or contaminants from entering inside the medical container, as well as at the interface between the elastomeric piece and the septum, and thus allows asepsis maintenance. Moreover, the presence of the pierceable elastomeric piece of the adaptor of the invention gives time to the septum of the medical container to reseal, as the needle is still present in the pierceable elastomeric piece after it is removed from the septum. As such, neither air nor contaminants may be introduced in the medical container or at the interface between the elastomeric piece and the septum, even if the medical container is maintained under negative pressure after the removal of one or more doses of product. In addition, the septum of the medical container may itself be self-resealing.

Suitable materials for self-resealing pierceable elastomeric piece of the adaptor of the invention include synthetic polyisoprene, natural rubber, silicone rubber, thermo-plastic elastomers, or the like or a combination thereof.

In embodiments, the pierceable elastomeric piece may further comprise a material including antiseptic agents, such as silver ions or copper ions. For example, silver salt or copper salt may be covalently linked to a polymer matrix present in the material comprised in the pierceable elastomeric piece. Alternatively, silver salts or copper salts may be introduced as a load during the manufacturing of the polymer present in the material comprised in the pierceable elastomeric piece. For example, the polymer matrix may be selected from silicone rubber, butyl rubber and/or halogenobutyl rubber. In embodiments, the perceable elastomeric piece comprises a material comprising a silicone rubber including silver ions: such products are commercially available from the company Momentive Performance Materials under the tradenames "Statsil®" or "Addisil®". In embodiments, the pierceable elastomeric piece may consist in a material including silver ions, such as silicone rubber including silver ions. In other embodiments, the pierceable elastomeric piece may consist in a material including copper ions.

Pierceable elastomeric pieces of the adaptor of the invention, comprising a material including antiseptic agents, such as silver ions or copper ions, show antiseptic and hydrophobic properties. The growth of bacteria is therefore directly prevented at the surface of the pierceable elastomeric piece. Moisture formation is also prevented, thereby further reducing the growth of bacteria. As a consequence, when a needle pierces a pierceable elastomeric piece of the adaptor of the invention comprising a material including antiseptic agents, such as silver ions or copper ions, in view of entering a medical container for removing a dose of product from said medical container, the risk of contamination of the medical container content is reduced.

In other embodiments or in combination, the pierceable elastomeric piece may comprise a coating comprising an antiseptic agent, such as chlorhexidine di-acetate. For example, the pierceable elastomeric piece may comprise a butyl rubber or a halogenobutyl rubber coated with a coating comprising chlorhexidine di-acetate. Such a coating may be obtained by UV cross-linking. The antiseptic action of such a coating may occur within minutes and such a coating may therefore be able to clean a contaminated needle during its insertion within the pierceable elastomeric piece.

For example, a solution of chlorhexidine di-acetate may be applied on the pierceable elastomeric piece before being submitted to UV cross-linking. Such coatings are very interesting as they have fast kinetic (within minutes) and therefore can clean a needle during its insertion within the pierceable elastomeric piece.

In embodiments, the distal surface of the pierceable elastomeric piece 30 is complementary to the whole outer surface of the septum 8. As such, whatever the piercing location of the pierceable elastomeric piece of the adaptor by the needle, the user is ensured that the distal tip of the needle will directly pierce the septum after being passed through the pierceable elastomeric piece. Therefore, said distal tip is not in contact with ambient air or with foreign elements that would be trapped between the outer surface of the septum and the surface of the pierceable elastomeric piece. In particular, in such embodiments, the outer surface of the septum and the complementary surface of the pierceable elastomeric piece match each other in such a way that they are in intimate contact together on their entire surface and lead to a closed interface.

The tubular wall 42 is provided with an opening 44 on a part of its circumference, herein called "front part" of the compressive member 40, said opening 44 being intended to face and receive the free ends 22*a* of the gripping member 20 when the gripping member 20 and the compressive member 40 are assembled together to form the adaptor of FIG. 12.

On each side of the opening 44, the tubular wall 42 is provided with a first recess 45*a* and a second recess 45*b*, proximally spaced from the first recess 45*a*. Furthermore, a rear recess 46 is arranged in the rear portion of the tubular wall 42, the rear recess 46 and second recesses 45*b* being located substantially in one and the same transversal plane.

An additional hole 66 is arranged in the transversal wall 41*a* for receiving a part of the cover 60 capable of cooperating with the connection member 65 of the gripping member 20 to allow said cover 60 to rotate between its first and second positions.

The compressive member 40 further comprises second guiding means which, in the embodiment shown, comprise a substantially longitudinal housing 52 at each side of the opening 44. As shown in FIG. 11, each housing 52 is formed by a wall 53 having a L-shaped cross section and protruding inwardly from the tubular wall 42. Therefore, each housing 52 is opened inwardly, and also has an open distal end. Moreover, the distal face 54 of the housing 52 is offset proximally with respect to the distal face of the tubular wall 42 of the compressive member 40.

The compressive member 40 further comprises first rotational blocking means. In the embodiment shown, the first rotational blocking means comprise a substantially longitudinal slot 71 which is arranged on each side of the opening 44 and is open outwardly. For example, each slot 71 can be located on the compressive member 40 adjacent the longitudinal housing 52, for example on the outer face of said housing 52.

FIG. 12 shows the gripping member 20 mounted in the compressive member 40, prior to the first use of the adaptor 2.

The tubular walls 22 and 42 are substantially coaxial, the tubular wall 22 of the gripping member being located inward from the tubular wall 42 of the compressive member 40. Besides, each leg 51 of the gripping member 20 is received in the corresponding housing 52 of the compressive member 40, the flexible tab 26 extending from the distal end of one leg 51 coming out from the open distal end of the longitudinal housing 52. Moreover, the pegs 23 are each engaged in a first recess 45*a*.

Figure 18:
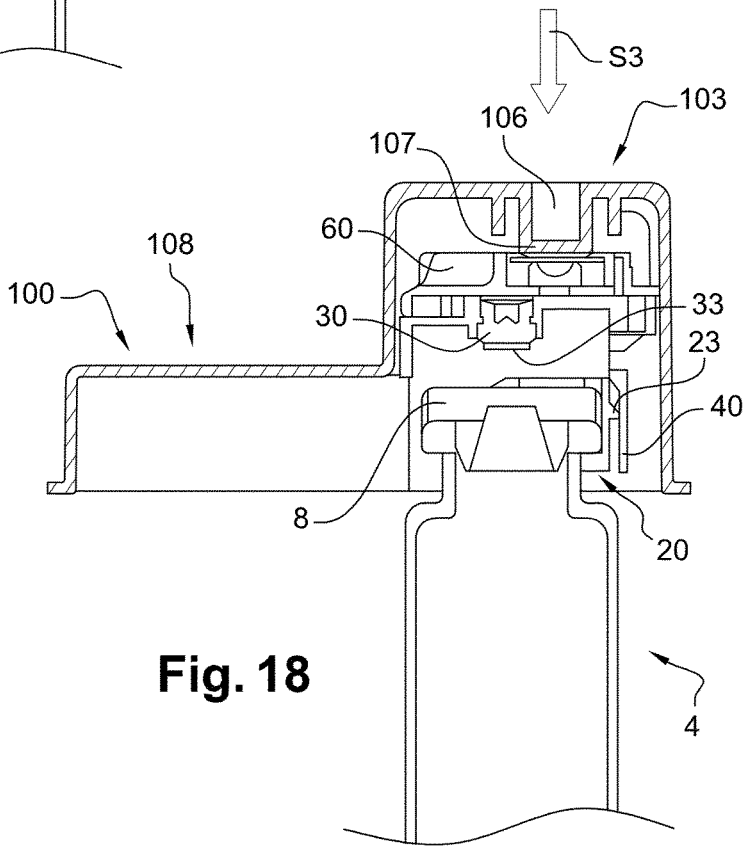
Figure 19:
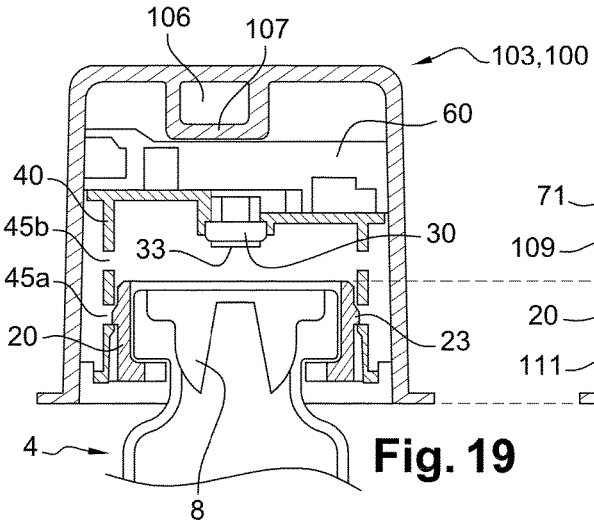
FIG. 19 is a cross section view of the assembly of FIG. 1 secured on a medical container, in the plane P1 of FIG. 7, with the compressive member in the inactive state.

The compressive member 40 is then in an inactive state, in which the pierceable elastomeric piece 30 is intended not to be in contact with pressure with the outer surface 9 of the septum 8—when the adaptor 2 is secured on the medical container 4 as shown in FIGS. 18 and 19.

Figure 23:
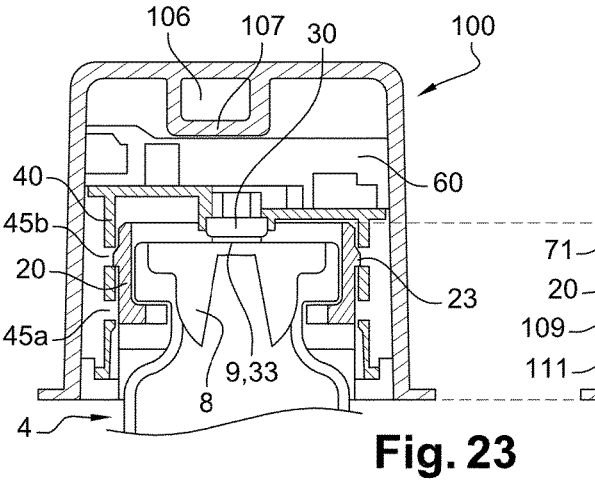
FIGS. 23 and 24 are similar to FIGS. 19 and 20, respectively, with the compressive member in the active state.

The compressive member 40 is movable relative to the gripping member 20 from this inactive state towards an active state, in which the pierceable elastomeric piece 30 is intended to be in contact with pressure with the outer surface 9 of the septum 8—when the adaptor 2 is secured on the medical container 4, as shown in FIG. 23.

The movement of the compressive member 40 from the inactive state to the active state is a longitudinal translation in the distal direction with respect to the gripping member 20. This movement is guided by means of the cooperation between the first guiding means and the second guiding means, the legs 51 being arranged to slide inside the housings 52. In the active state, the pegs 23 and the rear peg 25 are engaged respectively in a second recess 45*b* and in the rear recess 46.

The pegs and recesses form means capable to cooperate to maintain the compressive member 40 in the inactive or in the active position relative to the gripping member 20.

The shell 100 of the blister 3 is now described in detail with reference to FIGS. 13 to 16.

The shell 100 comprises a receiving portion 103 for housing the adaptor 2, which can have a substantially parallelepiped shape having a top wall 104 and four side walls 105*a*, 105*b*, 105*c*, 105*d*. The top wall 104 can be substantially flat and provided with a recess 106 having a bottom wall 107.

The shell 100 further comprises an insertion portion 108 forming a lateral extension of the receiving portion 103 from one side wall 105*d*, and designed to receive the upper part of the medical container 4 in a first step of the mounting process of the adaptor 2 on the medical container 4. The insertion portion 108 can have a substantially parallelepiped shape. The inner space of the insertion portion 108 and the inner space of the receiving portion 103 are connected via an opening arranged in the side wall 105*d*.

At least one side wall, and preferably two opposite side walls 105*a*, 105*c*, comprise on their inner face a substantially longitudinal rib 109, which may further be located between two substantially longitudinal grooves 110. The longitudinal ribs 109 and/or grooves 110 form second rotational blocking means designed to cooperate with the first rotational blocking means arranged on the compressive member 40. More precisely, each rib 109 is engaged in a slot 71, to prevent a rotation of the compressive member 40 relative to the shell 100 around a longitudinal axis. By blocking the rotation of the adaptor 2 relative to the shell 100, the rotational blocking means are particularly valuable for the ease of assembly of the adaptor 2 on a medical container 4.

Each rib 109 is further provided with a notch 111 which is opened inwardly and which pertains to or constitute second retaining means. The first retaining means arranged on the adaptor—namely the flexible tabs 26 of the gripping member 20—and the second retaining means arranged on the shell 100—namely the notches 111—form a retaining system. They are designed to cooperate when the compressive member 40 is in the inactive state, and as long as it is not in the active state, as will be explained later.

Figure 16:
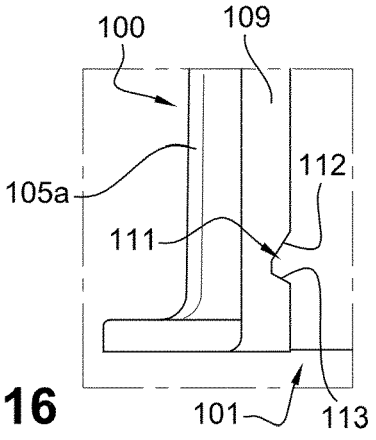
FIG. 16 is a detailed view of FIG. 15.

The notch 111 can have a sloped proximal edge 112 and a distal edge 113 arranged substantially transversally or with a slight slope, to create a stop capable of retaining the adaptor 2, as shown in FIG. 16.

The use of the assembly 1 in connection with a medical container 4 of FIGS. 2 to 4 will now be explained with reference to FIGS. 17 to 24.

The adaptor 2 is provided to the user with the gripping member 20, the pierceable elastomeric piece 30 and the compressive member 40 assembled together in the inactive state of the compressive member 40 as shown on FIGS. 1 and 12, and packed in a blister 3, in the receiving portion 103. In this position, the central hole 43 with the elastomeric piece 30 faces the central hole 28 of the gripping member 20. The ribs 109 are engaged in the slots 71, and the bottom 107 of the recess 106 of the shell 100 is close to the top face of the cover 60.

Figure 20:
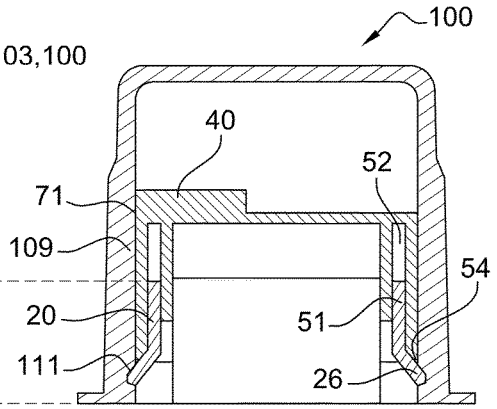
FIG. 20 is a cross section view of the assembly of FIG. 1, in the plane P2 of FIG. 7, with the compressive member in the inactive state.

Furthermore, the flexible tabs 26, which projects from the body 21 of the gripping member 20 outwardly towards the shell 100, are in a locked position in which they are engaged in the notches 111, which are opened towards the adaptor 2, thereby preventing the shell 100 of the blister 3 from being separated from the adaptor 2 (see FIG. 20).

Once the user is ready to proceed to the withdrawal of a dose of product contained in the medical container 4, he removes the closing membrane 102 in order to open the blister 3. Because of the previously described retaining system, more precisely because of the cooperation between the flexible tabs 26 and the notches 111, the shell 100 remains on the adaptor 2 until the adaptor 2 is secured on the neck 7 of the medical container 4, and as long the compressive member 40 is not in the active state. The adaptor 2 cannot slide out of the blister 100 and contact contaminated surfaces. Moreover, the opportunity of direct contact between the user hands and the adaptor 2 is limited, as the user only handles the shell 100 of the blister 3.

Only after the compressive member 40 is in the active state will it be possible for the user to remove the shell 100, in order to pierce the elastomeric piece 30 by the needle of an injection device.

Figure 17:
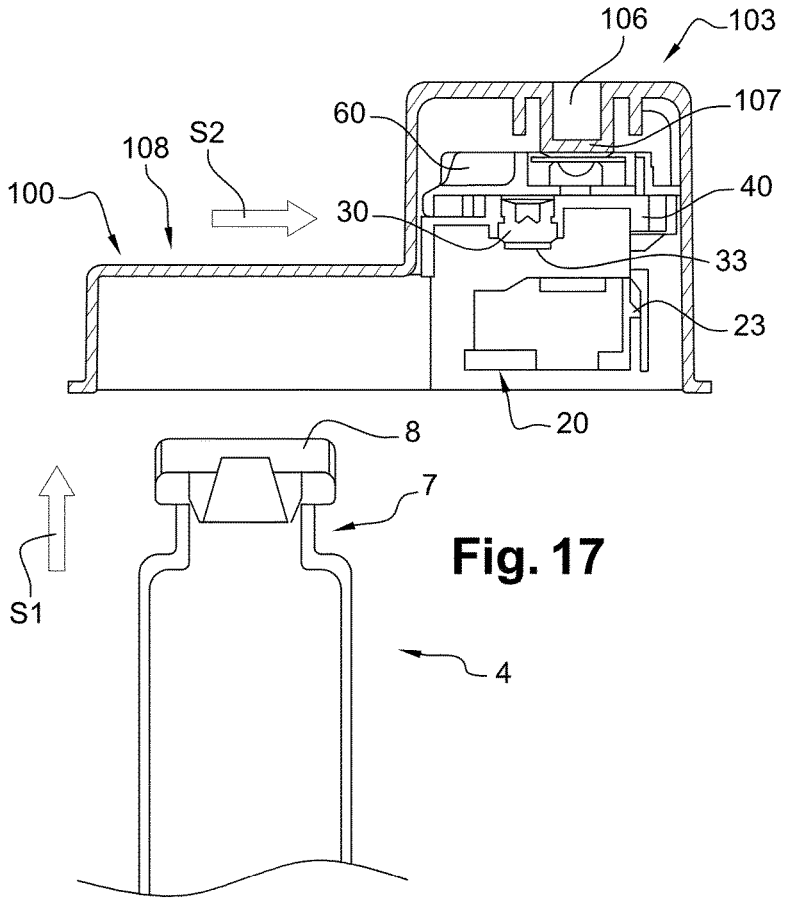
FIGS. 17 and 18 show the installation of the assembly of FIG. 1 on a medical container.

With reference to FIG. 17, during a first step illustrated by arrow S1, the user engages the top part of the medical container 4 in the insertion portion 108 of the shell 100 and then, during a second step illustrated by arrow S2, moves the medical container 4 along D2 towards the receiving portion 13 of the shell 100, in order to mount laterally the adaptor 2 onto the neck 7 of the medical container 4.

When the medical container 4 is properly mounted in the adaptor 2, as shown in FIGS. 18 and 19, the adaptor 2 is placed on the neck 7 by means of the forward projection 29 and the radial rims 27 surrounding the collar 3, as well as the inner annular rim 21*a*. In this position, the pierceable elastomeric piece 30 is not in contact with pressure with the outer surface 9 of the septum 8. The adaptor 2—and the compressive member 40—are then in the inactive state. For example, in the depicted embodiment, the pierceable elastomeric piece 30 is spaced apart from the septum 8. Moreover, the lateral mounting of the gripping member 20 allows a precise positioning of the adaptor 2 onto the medical container neck 7. The connection of the adaptor 2 on the medical container 4 is straightforward for the user and can be performed easily, even with a single hand.

Then, as the adaptor 2 and, in this embodiment, the compressive member 40, are in the inactive state, as illustrated in FIG. 19, the pegs 23 are engaged in the first recesses 45*a*, thereby maintaining the compressive member 40 in the inactive state.

Moreover, as explained before, owing to the retaining system (i.e. the flexible tabs 26 engaged in the notches 111 as shown in FIG. 20, in a fully locked position), the shell 100 cannot be removed from the adaptor 2 mounted on the medical container 4 at this step of the mounting process. This ensures that the adaptor 2 is not removed from the blister 3 and mounted independently on the medical container 4, and therefore limits contacts between user's hands and the septum 8, the adaptor 2 or the pierceable elastomeric piece 30.

During a third step of the mounting process, illustrated by arrow S3 of FIG. 18, the shell 100 is moved distally towards the medical container 4, for example by a distal pressure exerted by the user on the top wall 104. Because the bottom 107 of the recess 106 of the shell 100 is adjacent to the top face of the cover 60 and the cover 60 is adjacent the transversal wall 41*a* of the compressive member 40, this results in the compressive member 40 being moved distally relative to the gripping member 20.

In other words, the medical container 4 is moved proximally, which causes the gripping member 20 to also move proximally relative to the compressive member 40, because the medical container 4 pushes proximally the inner annular rim 21*a* of the gripping member 20.

For a proper use of the assembly 1, and for ensuring an air-tight interface between the pierceable elastomeric piece 30 and the septum 8 of the medical container 4, this third step has to be performed until the compressive member 40 is in the active state.

Figure 21:
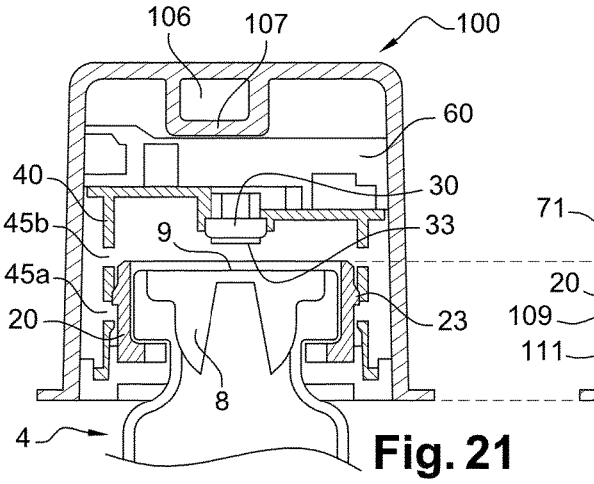
FIGS. 21 and 22 are similar to FIGS. 19 and 20, respectively, with the compressive member in position intermediate between the inactive and the active state.
Figure 22:
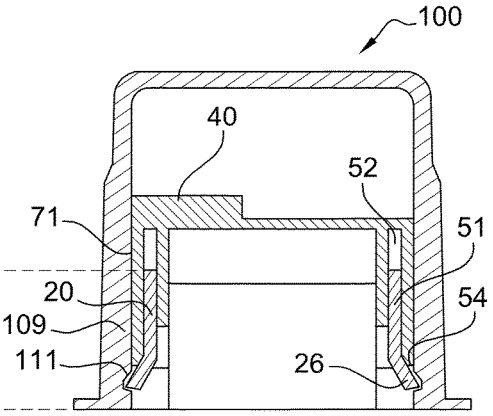

At the beginning of this movement, the gripping member 20 has been moved proximally relative to the compressive member 40, the later is therefore not in the inactive state anymore, as shown in FIGS. 21 and 22. In this intermediate position, the pegs 23 have come out of the recesses 45*a*, this being facilitated by their sloped proximal face 23*a*.

During this movement, the legs 51 slide proximally in the housings 52, and the distal face 54 of each housing 52 come in contact with the corresponding flexible tab 26 and cause it to be deflected towards the body 21 of the gripping member 20 as the gripping member 20 moves proximally relative to the compressive member 40.

However, the assembly 1 is designed such that, as long as the compressive member 40 is not in the active state, the flexible tabs 26, even if they have been deflected as compared to their locked position, still cooperate with the notches 111 in order to prevent the shell 100 from being separated from the adaptor 2. As compared to breakable tabs, flexible tabs 26 provide a very efficient locking in the locked position, where it is difficult to separate the shell 100 from the adaptor 2 as long as a medical container 4 is not placed on the gripping member.

This ensures that a syringe cannot be filled with a dose of drug contained in the medical container 4 when the adaptor 2 is in its active state, insofar as the adaptor 2 is still housed in the shell 100. Indeed, as shown in FIG. 21, it would not be desirable to allow filling a syringe in this position of the adaptor 2, because the pierceable elastomeric piece 30 is then not in contact with the septum 8, and therefore the hygienic requirements are not met.

Figure 24:
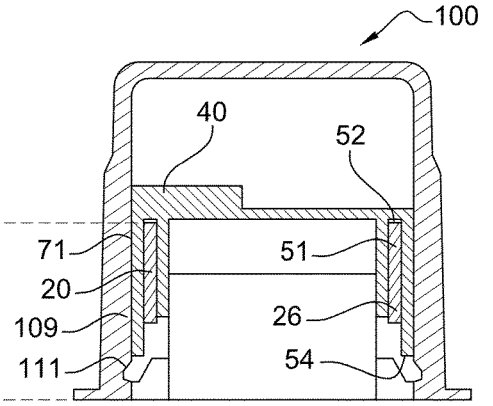

When the compressive member 40 is in the active state, as shown in FIGS. 23 and 24, the pegs 23, 25 are engaged in the recesses 45*b*, 46, which maintains the compressive member 40 in the active state. The pierceable elastomeric piece 30 is then in contact with pressure with the septum 8, and filling a syringe can then be performed while avoiding contaminating the pharmaceutical product by sucking outside air inside the medical container or introducing contaminants through the septum by the syringe needle.

In this active state, the flexible tabs 26 have been greatly deflected by the distal face 54 of the corresponding housing 52 acting as an unlocking means capable of moving, breaking or deforming the first retaining means—i.e. the flexible tabs 26—towards an unlocked position. In this unlocked position, the flexible tabs 26, which for example substantially do not protrude from the body 21, do not cooperate any more with the notches 111, as shown in FIG. 24. A user can therefore remove the shell 100 from the adaptor 2, while avoiding direct contact with the adaptor 2 or the external surface 9 of the septum 8. Moreover, any risk of undesired cooperation between the flexible tabs 26 and the notches 111 during removal of the adaptor 2 is avoided, as the flexible tabs 26 are now hidden by the compressive member 40. As compared to breakable tabs, flexible tabs 26 allow a smooth transition from the locked position to the unlocked position, and separation of the adaptor 2 from the blister 3 is performed without additional effort as compared to the activation of the compressive member 40.

The invention is of course not limited to the embodiments described above as examples, but encompasses all technical equivalents and alternatives of the means described as well as combinations thereof.

For example, in the embodiment described, the unlocking means are arranged on the compressive member and are formed by a part of the second guiding means. However, in other embodiments (not shown), the compressive member and the gripping member could be formed of one single part. In these embodiments, the gripping member could be an axial clipping member comprising a substantially tubular body.

The invention claimed is:

1. An assembly comprising:

an adaptor for coupling with a medical container having a neck closed by a septum, said septum having an outer surface directed towards an outside of the medical container, the adaptor comprising:

a gripping member for securing the adaptor to the medical container, said gripping member adapted to be mounted on the neck of said medical container;

a pierceable elastomeric piece which, in an inactive state of the adaptor, is not in contact with pressure with the outer surface of the septum, and which, in an active state of the adaptor, is in contact with pressure with the outer surface of the septum when said adaptor is placed on said medical container;

a blister comprising a shell and a removable closing membrane which form a housing receiving the adaptor with the adaptor in the inactive state, prior to the first use of the adaptor;

wherein the assembly further comprises:

a retaining system which comprises a first retaining portion arranged on the adaptor and a second retaining portion arranged on the shell, the first retaining portion being adapted, in a locked position of the retaining system, to cooperate with the second retaining portion, as long as the adaptor is not in the active state, so as to prevent the shell from being separated from the adaptor;

an unlocking member adapted to transition the retaining system to an unlocked position, when the adaptor is in the active state, in which unlocked position, the first retaining portion does not cooperate with the second retaining portion, thereby allowing removal of the shell.

2. The assembly according to claim 1, wherein one of the first retaining portion and the second retaining portion comprise a notch and the other of the first retaining portion and the second retaining portion comprise a projecting member, the notch being opened towards the projecting member and the projecting member projecting towards the notch.

3. The assembly according to claim 1, wherein the unlocking member comprises a wall which, when the adaptor changes from its inactive position to its active position, is designed to come in contact with a part of the retaining system and to cause said part to move or to break, in order to place the retaining system in the unlocked position.

4. The assembly according to claim 1, wherein the adaptor further comprises a compressive member which comprises said pierceable elastomeric piece and which is movable relative to the gripping member from an inactive state, in which the pierceable elastomeric piece is not in contact with pressure with the outer surface of the septum when said adaptor is placed on said medical container towards an active state, in which the pierceable elastomeric piece is in contact with pressure with the outer surface of the septum when said adaptor is placed on said medical container.

5. The assembly according to claim 4, wherein the first retaining portion is arranged on the gripping member, and wherein the unlocking member is arranged on the compressive member.

6. The assembly according to claim 1, wherein the gripping member comprises a body, the first retaining portion is arranged on the gripping member and comprises at least one projecting member which projects from said body towards the shell, in the locked position, and which can be broken or deformed towards the unlocked position such that the at least one projecting member does not substantially protrude from the body.

7. The assembly according to claim 6, wherein the projecting member comprises at least one breakable or flexible tab which projects outwardly and distally from the body, in the locked position, and which can be broken or deflected substantially against the body.

8. The assembly according to claim 1, wherein the gripping member is a lateral clipping member having a U-shaped body adapted to be engaged on the neck of the medical container via an opening of the U-shaped body, a curved part of the U-shaped body partially surrounding the neck, the first retaining portion being arranged on the gripping member substantially on at least one free end of the U-shaped body.

9. The assembly according to claim 4, wherein the gripping member comprises a first guiding portion adapted to cooperate with a second guiding portion arranged on the compressive member to guide the movement of the compressive member relative to the gripping member from the inactive state towards the active state, according to a longitudinal translation in a distal direction.

10. The assembly according to claim 9, wherein a part of the second guiding portion forms the unlocking member.

11. The assembly according to claim 9, wherein the first guiding portion comprises a substantially longitudinal leg and the second guiding portion comprises a substantially longitudinal housing which receives said leg and has an open distal end, a flexible tab extends from a distal end of the leg and comes out from the open distal end of the longitudinal housing.

12. The assembly according to claim 4, wherein the compressive member comprises a first rotational blocking portion adapted to cooperate with a second rotational blocking portion arranged on an inner lateral face of the shell, to prevent rotation of the compressive member relative to the shell around a longitudinal axis.

13. The assembly according to claim 11, wherein the first rotational blocking portion is located on the compressive member adjacent the longitudinal housing and wherein the second retaining means are located on the shell adjacent the second rotational blocking portion.

14. The assembly according to claim 13, wherein the first rotational blocking portion comprises a substantially longitudinal slot and wherein the second rotational blocking portion comprises a substantially longitudinal rib having a notch for cooperating with the second retaining portion.

15. The assembly according to claim 1, further comprising a medical container having a neck closed by a septum, said septum having an outer surface directed towards the outside of the medical container.

* * * * *